US005967377A

United States Patent [19]

Glynn

[11] Patent Number: 5,967,377

[45] Date of Patent: Oct. 19, 1999

[54] METERED LIQUID DISPENSER WITH LIFT FILL MECHANISM

[75] Inventor: Kenneth P. Glynn, Raritan Township, Hunterdon County, N.J.

[73] Assignee: Primary Delivery Systems, Inc., Easton, Pa.

[21] Appl. No.: 09/276,081

[22] Filed: Mar. 25, 1999

[51] Int. Cl.[6] ..... B67D 5/06

[52] U.S. Cl. ..... 222/158; 222/205; 222/207; 222/211; 222/320

[58] Field of Search ..... 222/158, 205, 222/207, 211, 212, 320, 382, 464.1

[56] References Cited

U.S. PATENT DOCUMENTS

| | | | |
|---|---|---|---|
| 2,593,591 | 4/1952 | Menkin et al. | 222/205 |
| 2,774,517 | 12/1956 | Teegardin et al. | 222/205 |
| 3,739,955 | 6/1973 | Gores | 222/205 X |
| 4,105,142 | 8/1978 | Morris, Jr. | 222/158 |
| 4,757,922 | 7/1988 | Landecker | 222/205 |
| 4,875,603 | 10/1989 | Weinstein | 222/205 |
| 4,941,598 | 7/1990 | Lambelet, Jr. et al. | 222/321 |
| 5,014,881 | 5/1991 | Andris | 222/207 |
| 5,184,760 | 2/1993 | Weinstein et al. | 222/207 |
| 5,330,081 | 7/1994 | Davenport | 222/207 |
| 5,636,765 | 6/1997 | DeJonge | 222/207 X |

*Primary Examiner*—Kevin P. Shaver
*Attorney, Agent, or Firm*—Kenneth P. Glynn, Esq.

[57] ABSTRACT

The present invention is a metered liquid dispenser. A liquid dispenser has a liquid volume metering element located on a base attached to the top of the neck of a liquid dispenser. Using a lift fill mechanism, the metering element is vertically slid relative to the base to dispense a measured liquid volume. One-way valves located in the base and the top of the metering element alternately act to displace air from the element, and then provide suction to draw a measured liquid volume from the liquid dispenser through a dip tube into the element. The liquid is dispensed by inverting the metered liquid dispenser. The metering element has liquid level markings to indicate the liquid volume being entered to the element for dispensing, and is preferable partly transparent to visually display the liquid in the metering element.

20 Claims, 1 Drawing Sheet

METERED LIQUID DISPENSER WITH LIFT FILL MECHANISM

BACKGROUND OF THE INVENTION

1. Field of the Invention

This invention is a metered liquid dispenser. With a liquid volume metering element attached to the top of a liquid dispenser, a lift fill mechanism is used to dispense a measured volume of liquid as indicated by liquid volume markings on the metering element.

2. Information Disclosure Statement

U.S. Pat. No. 2,593,591 to Benjamin David Menkin et al. describes a fluid dispenser which comprises a container, cylinder means removably mounted upon said container and depending thereinto, piston means mounted for reciprocation within and normally projecting yieldably upwardly beyond said cylinder means and including axially spaced abutments, said cylinder and piston means defining a continuous communicating fluid passage therethrough, valve means in said cylinder means and said piston means, the latter means being effective to pump a fluid upwardly from said container through said passage, and an axially ported cup disposed at the upper end of said piston means in a position to receive a flow from said passage: a wall of the cylinder being formed with radial holes in axially spaced relationship, a spring clamp clampable around the cylinder and including an end adapted to be carried in any selected hole for engagement with said abutments to adjust the extent of relative reciprocating movement of the piston means within the cylinder means.

U.S. Pat. No. 2,774,517 to James E. Teegardin et al. describes a fluid dispensing device which comprises a cylinder, an internal projection means in the wall of the cylinder, a resilient piston operatively mounted in the cylinder, a resilient external projection means associated with the piston for limiting its stroke in the cylinder, the resiliency of the piston and the external projection means being adapted for snapping them past the internal projection means into the cylinder, a valve mounted in the wall of the cylinder for valving fluid thereinto, a second valve for valving fluid out of the cylinder, and a spring means for urging the piston through a return stroke.

U.S. Pat. No. 4,757,922 to David J. Landecker describes a dispenser for liquid acrylic resin and powder, the dispenser having a dish, a raised inlet above the dish, and a shield for the inlet. A bottle or the like is mounted in coaxial relation therewith for dispensing fresh quantities of liquid from the reservoir bottle to the dispenser dish. The outlet in the dispenser dish is above the level of the liquid contained in the dish to prevent return of the liquid and has an umbrella-like shield over the inlet to prevent the backflow to prevent contaminated resin from returning to the bottle.

U.S. Pat. No. 4,875,603 to Jack Weinstein describes a metered dispensing cap system for containers such as tubes and the like. The system has a base element which is attachable to the neck of a squeezable container and which has a sidewall portion and a top. The base element has an opening in the top for outflow of a material from a squeezeable container into a meter element. This base element may be removably attachable, e.g. by being screwed on, or may be permanently attached, e.g. by being integrally molded with the container. A one way valve is located in the opening of the base element to permit the flow of material from a container through the opening while preventing backflow. The system also includes a meter element which acts like an inverted trap and which has a sidewall portion and a top with an opening in the top for dispensing of the material therefrom. The sidewall portion of the meter element is slightly larger than and has the same across section shape as the sidewall portion of the base element and this sidewall portion of the meter element is higher than and located about and encompasses the sidewall portion of the base element. Further, the meter element is vertically slidable along the sidewall portion of the base element with an upward position for receiving a volume of material in a predetermined amount when the squeezeable container is squeezed and downward position whereby the opening in the top of the meter element allows for dispensing of the desired amount of fluid when the meter element is pushed down.

U.S. Pat. No. 4,941,598 to Lawrence E. Lambelet, Jr. et al. describes an apparatus for dispensing predetermined amounts of viscous product. The apparatus has a conduit which is telescopically received with a cap. The cap and conduit define an expandable dosing chamber which expands to a predetermined maximum volume when product is introduced into the chamber through the conduit. A check valve prevents back flow of product through the conduit. Collapsing the chamber from its maximum volume to a minimum volume dispenses the product from the dosing chamber.

U.S. Pat. No. 5,014,881 to Raimund Andris describes how in order to create a metering and spray pump of high functional reliability, consisting of as few individual parts as possible and able to be produced with as low production costs, in particular assembly costs, as possible, in which the pumping member consists of an elastically-flexible bellows, which is arranged connectively between mutually movable, dimensionally stable housing parts, the bellows has at its one end, as axial extension, a radially flexible, sleeve-like annular wall section, which encloses in sealing manner like a valve the circumferential surface of a socket, in the form of a ring or pot, integrally molded onto the housing part executing the pumping strokes. The other end of the bellows is provided with an end wall section which has at least one passage opening and covers like a valve one or more outlet openings of a housing end wall of the second housing part or forms the valve seat for a valve closing member which is molded onto a displacement body arranged in the bellows.

U.S. Pat. No. 5,127,553 to Jack Weinstein describes a present invention which is a liquid metered dispensing container of the squeezable type. The squeezable container has an opening for dispensing liquid therefrom at one end and a bottom at the other end. A non-flexible trap chamber is connected to the opening and extends outwardly therefrom. The trap chamber has a lower end inserted into the container opening and has an inlet orifice extending from the lower end into the container. The inlet orifice is adapted to receive a dip tube which is attached thereto and extends close to or at the bottom of the container. The trap chamber has an upper end with a dispensing orifice. This is small enough to prevent dripping of liquid therefrom by gravity when the bottle is inverted but is large enough to dispense liquid therefrom when the bottle itself is squeezed. A one way valve is connected to the lower end of the trap chamber which permits liquid to flow from the container to the trap chamber but not vice versa. The trap chamber may have indicia so that exact dosage levels of different amounts may be squeezed into the chamber, or the chamber itself may have a single, predetermined volume.

U.S. Pat. No. 5,330,081 to Robert A. Davenport describes a portion measuring device of the type having a first, flexible reservoir having an inlet, and a second, portion measuring, reservoir in fluid communication with said first reservoir.

The first, flexible, reservoir is of a larger volume than that heretofore known, and may have a handle to aid in holding. The second, portion measuring, reservoir has a rotatable closure with a pouring spout or opening therein. A configured periphery is provided on the closure to aid in turning the same.

Notwithstanding the prior art, the present invention is neither taught nor rendered obvious thereby.

SUMMARY OF THE INVENTION

The present invention is a metered liquid dispenser. A liquid dispenser has a liquid volume metering element located on a base attached to the top of the neck of a liquid dispenser. Using a lift fill mechanism, the metering element is vertically slid relative to the base to dispense a measured liquid volume. One-way valves located in the base and the top of the metering element alternately act to displace air from the element, and then provide suction to draw a measured liquid volume from the liquid dispenser through a dip tube into the element. The liquid is dispensed by inverting the metered liquid dispenser. The metering element has liquid level markings to indicate the liquid volume being entered to the element for dispensing, and is preferable partly transparent to visually display the liquid in the metering element.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
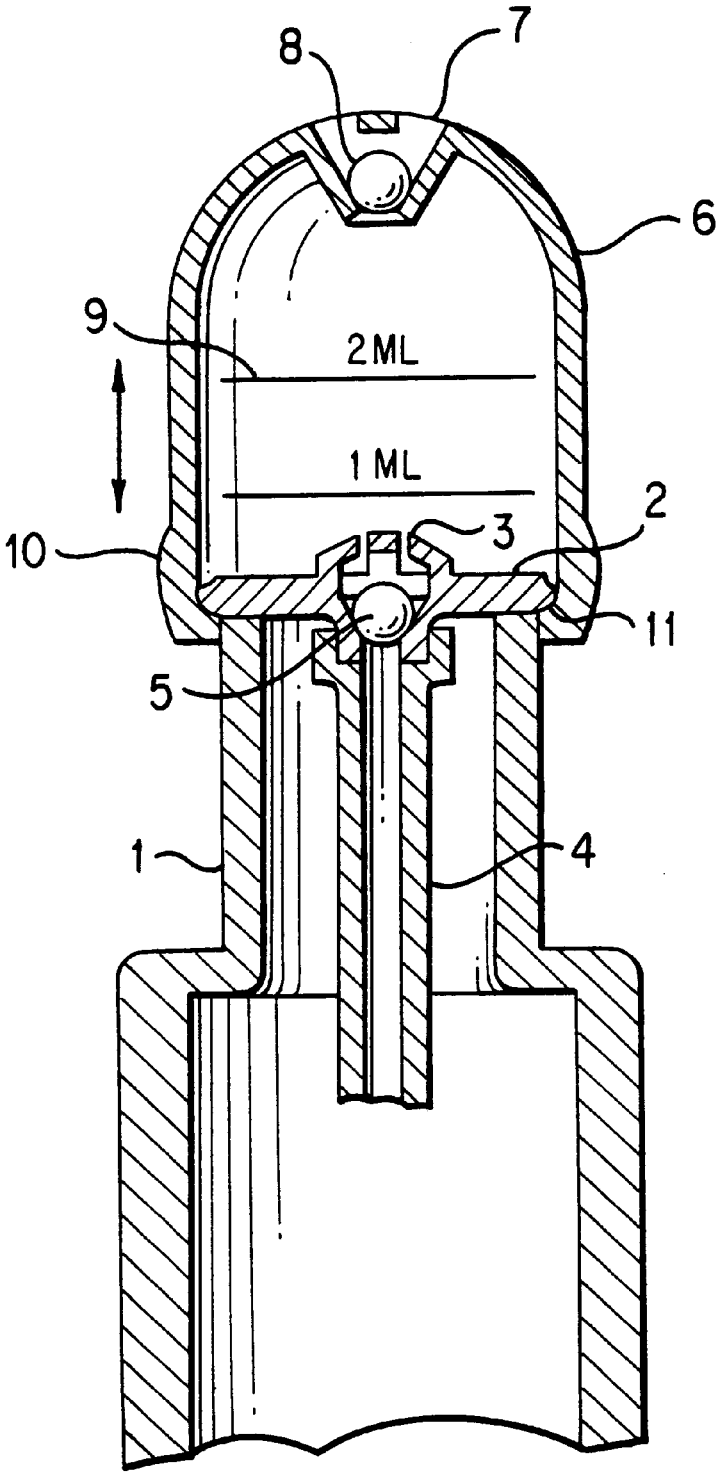
FIG. 1 shows a cut-away view of a present invention metered liquid dispenser, showing the liquid dispenser, the metering element attached to the neck of the liquid dispenser, and the valves arranged for both filling the metering element from the liquid dispenser, and then dispensing the liquid from the metering element.

The present invention is a metered liquid dispenser equipped to dispense a measured volume of liquid. A liquid dispenser has a metering element attached which is filled with a measured volume of liquid from the liquid dispenser, and then is dispensed.

Referring to FIG. 1, a base element 2 is shown attached to the top of a neck 1 of a liquid dispenser. The base element contains an opening 3 through which liquid contained in the liquid dispenser can pass into the metering element 6 via dip tube 4 and one-way valve 5.

The metering element 6 is slideably connected to base 2 for vertical movement relative to the base. The metering element has an opening 7 through which air or liquid can pass as controlled by one-way valve 8 located at opening 7 at the top of the metering element.

Measured volumes of liquid are dispensed by moving the metering element up and down relative to the base 2. Measured liquid volumes for dispensing are indicated on the metering element by markings 9, which indicate predetermined liquid volumes in the metering element.

A lift fill mechanism is used to move a measured volume of liquid from the dispenser into the metering element and then to dispense the liquid from the dispenser using the following movements of the metering element.

To initiate dispensing of a measured volume of liquid, the metering element is moved downward, closing one-way valve 5, and expelling air from the metering element through one-way valve 8 and opening 7 in the top of the metering element. Downward movement of the metering element is continued until the desired liquid volume marking on the metering element has moved to the top surface of base 2.

Then the metering element is moved vertically upward, closing valve 8 due to suction within the metering element, the suction also moving liquid upward into the metering element from the liquid dispenser through dip tube 4, one-way valve 5, and opening 3 in base 2. When the metering element has moved to the uppermost position, with lip 11 positioned on the bottom of the metering element against the outer diameter of base 2 as shown, the measured liquid volume has moved into the metering element ready for dispensing.

The metered liquid dispenser is then inverted allowing the liquid to be dispensed through one-way valve 8 and opening 7 at the tip of the metering element. The liquid will drain from the metering element by gravity feed, or, in a preferred embodiment shown below, may be expelled from the metering element by squeezing the liquid dispenser and/or the metering element. Although not shown on FIG. 1, dip tube 4 extends to the bottom of the liquid dispenser so that when the metered liquid dispenser is inverted, additional liquid cannot drain into the metering element. Thus, liquid in the liquid dispenser will not be added to the measured liquid volume in the metering element while being dispensed, maintaining the accuracy of the measured volume of liquid being dispensed.

With the metering element in its uppermost position, with lip 11 resting against base 2, the metering element is in position to begin a new series of vertical movements to accept a new volume of liquid from the liquid dispenser to be dispensed, when the metered liquid dispenser is returned to the upright position.

The metering element has external finger gripping surfaces 10 to assist in manually moving the metering element up and down in dispensing the liquid.

In a preferred embodiment, the parts of metered liquid dispenser are made of plastic material. In particular, the liquid dispenser and/or the metering element having flexibility to be squeezed. Also, the metering element can have a round top as shown, helping to dispense the liquid from the metering element after it is filled and the liquid dispenser is inverted.

Additionally, the base 2 can be removably attached to neck 4 of the liquid dispenser, or can be permanently connected to the neck by being a part of the molding of the dispenser when manufactured.

The metering element 6 is preferably at least partially transparent allowing the liquid level in the metering element to be viewed when filled. Also, the one-way valves 5 and 8 can be ball valves.

Obviously, numerous modifications and variations of the present invention are possible in light of the above teachings. It is therefore understood that within the scope of the appended claims, the invention may be practiced otherwise than as specifically described herein.

What is claimed is:

1. A metered liquid dispenser with a lift fill mechanism which comprises:

(a) a container for storing and containing a liquid;

(b) a base element establishing a neck of said container having a sidewall portion and a top, and having an opening in said top for outflow of a liquid from a container into a meter element;

(c) a dip tube connected to said base element at said opening of said top and extending downwardly therefrom into said container;

(d) a first one-way valve located in said opening of said base element, permitting flow of material from said container through said opening and preventing backflow of liquid back into said container;

(e) a meter element having a sidewall portion and a top, and having an opening in said top for dispensing of material from said meter element, wherein the sidewall portion is slightly larger than and has the same cross-sectional shape as the sidewall portion of said base element, wherein said sidewall portion of said meter element is higher than and located about and encompasses the sidewall portion of said base, and wherein said meter element is vertically slidable along the sidewall portion of said base element, with an upward position whereby the meter element has a predetermined volume for receiving liquid from the opening at the top of said base element upon dispensing from said container, and a downward position whereby the top of the meter element becomes biased toward the top of the base element so as to force air out of said meter element through the valve and opening at the top of said meter element; and, (f) a second one-way valve located in said opening at the top of said meter element which permits outward flow from said meter element when said dispenser is inverted and which permits air or liquid to be expelled from said meter element when said meter element is moved slidably towards the base element, and which prevents air or liquid from exiting said meter element when said meter element is slidably moved away from said base element;

such that said meter element may be pushed down to force air therefrom through said second one-way valve and then may be pulled upward away from said base element to move liquid into said meter element via suction through said dip tube to fill to a predetermined amount and then said dispenser may be inverted for dispensing of liquid contained within said meter element.

2. The metered liquid dispenser with a lift fill mechanism of claim 1 wherein said base element is removably attached to the neck of container.

3. The metered liquid dispenser with a lift fill mechanism of claim 2 wherein said first valve and said second valve are ball valves.

4. The metered liquid dispenser with a lift fill mechanism of claim 2 wherein said meter element further includes at least a portion which is sufficiently transparent to visibly display liquid when contained therein.

5. The metered liquid dispenser with a lift fill mechanism of claim 2 wherein said meter element has indicia thereon to indicate dosage levels.

6. The metered liquid dispenser with a lift fill mechanism of claim 2 wherein said meter element has a rounded top to facilitate manual dispensing therefrom.

7. The metered liquid dispenser with a lift fill mechanism of claim 2 wherein said sidewall portions of said base element and said meter element have cylindrical cross-sectional shapes.

8. The metered liquid dispenser with a lift fill mechanism of claim 2 wherein said system is entirely constructed of plastic materials.

9. The metered liquid dispenser with a lift fill mechanism of claim 8 wherein said meter element further contains protrusions for finger gripping of same to facilitate manual vertical movement thereof.

10. The metered liquid dispenser with a lift fill mechanism of claim 8 wherein said meter element has a rounded top to facilitate manual dispensing therefrom.

11. The metered liquid dispenser with a lift fill mechanism of claim 8 wherein said first valve and said second valve are ball valves.

12. The metered liquid dispenser with a lift fill mechanism of claim 8 wherein said meter element further includes at least a portion which is sufficiently transparent to visibly display liquid when contained therein.

13. The metered liquid dispenser with a lift fill mechanism of claim 12 wherein said meter element has indicia thereon to indicate dosage levels.

14. The metered liquid dispenser with a lift fill mechanism of claim 8 wherein said sidewall portions of said base element and said meter element have cylindrical cross-sectional shapes.

15. The metered liquid dispenser with a lift fill mechanism of claim 8 wherein said system is entirely constructed of plastic materials.

16. The metered liquid dispenser with a lift fill mechanism of claim 8 wherein said base element is permanently attached to said squeezable container by being integrally formed as a part of said container during its manufacture.

17. The metered liquid dispenser with a lift fill mechanism of claim 16 wherein said first valve and said second valve are ball valves.

18. The metered liquid dispenser with a lift fill mechanism of claim 16 wherein said meter element further contains protrusions for finger gripping of same to facilitate manual vertical movement thereof.

19. The metered liquid dispenser with a lift fill mechanism of claim 16 wherein said sidewall portions of said base element and said meter element have cylindrical cross-sectional shapes.

20. The metered liquid dispenser with a lift fill mechanism of claim 16 wherein said system is entirely constructed of plastic materials.

* * * * *